US006941589B1

(12) United States Patent
Dural et al.

(10) Patent No.: US 6,941,589 B1
(45) Date of Patent: Sep. 13, 2005

(54) METHOD AND APPARATUS FOR CLEARING PLUGGED PIPES

(75) Inventors: Richard E. Dural, Las Vegas, NV (US); Christopher L. Brines, Prescott, AZ (US)

(73) Assignee: STM Enterprises, Inc., Las Vegas, NV (US)

( * ) Notice: Subject to any disclaimer, the term of this patent is extended or adjusted under 35 U.S.C. 154(b) by 0 days.

(21) Appl. No.: 10/881,848

(22) Filed: Jun. 30, 2004

Related U.S. Application Data

(60) Provisional application No. 60/483,738, filed on Jun. 30, 2003.

(51) Int. Cl.[7] ..... E03D 11/00
(52) U.S. Cl. ..... 4/255.01; 4/255.04; 4/255.06
(58) Field of Search ..... 4/255.01–255.12; 137/615; 239/106, 569, 532

(56) References Cited

U.S. PATENT DOCUMENTS

| | | | | | |
|---|---|---|---|---|---|
| 2,061,553 | A | * | 11/1936 | Acosta | 134/166 C |
| 2,413,997 | A | | 1/1947 | Rosa | |
| 2,753,876 | A | | 7/1956 | Kurt | |
| 2,755,810 | A | | 7/1956 | Kurt | |
| 3,075,535 | A | | 1/1963 | Lasting | |
| 3,537,113 | A | * | 11/1970 | Elzner | 4/255.05 |
| 3,595,255 | A | | 7/1971 | Mulinex | |
| 3,644,943 | A | | 2/1972 | Leonardo et al. | |
| 3,714,951 | A | | 2/1973 | Lundman | |
| 3,792,708 | A | | 2/1974 | Tash | |
| 3,802,449 | A | | 4/1974 | Mulinex | |
| 3,840,033 | A | | 10/1974 | Warsinger | |
| 3,937,404 | A | | 2/1976 | Johnson | |
| 3,952,341 | A | | 4/1976 | Cain | |
| 4,137,578 | A | | 2/1979 | Felici | |
| 4,144,598 | A | | 3/1979 | Li | |
| 4,320,539 | A | | 3/1982 | Li | |
| 4,354,515 | A | | 10/1982 | Sutherland | |
| 4,447,917 | A | | 5/1984 | Walter | |
| 4,475,255 | A | | 10/1984 | Tash | |
| 4,552,515 | A | | 11/1985 | Endo | |
| 4,606,364 | A | | 8/1986 | Tash | |
| 4,660,603 | A | | 4/1987 | Tash | |
| 4,672,988 | A | | 6/1987 | Tash | |
| 4,674,137 | A | | 6/1987 | Girse | |
| 4,745,641 | A | | 5/1988 | Tash | |
| 4,756,480 | A | * | 7/1988 | Fish | 4/255.06 |
| 4,768,237 | A | * | 9/1988 | Torti | 4/255.05 |

(Continued)

*Primary Examiner*—Khoa D. Huynh
(74) *Attorney, Agent, or Firm*—Stetina Brunda Garred & Brucker

(57) ABSTRACT

A drain clearing device for use on unvented plumbing fixtures having a drain and a holding tank is provided having a valve body. The valve body has a first end and a second end with a fluid flow channel therethrough, and a valve connected to a handle actuated to open and close to valve. A first fitting member and a second fitting member are connected to the first and second end of the valve body, respectively. Each of the first and second fitting members has a threaded portion on an interior sidewall thereof. A hose adaptor is connected to the first fitting member. A pipe has a first end and a second end is provided. The first end of the pipe has a threaded portion engageable with the threaded portions of the first and second fitting members to fasten the pipe in a retracted or extended position. The second end of the pipe has a seal. The seal is sufficiently compressible such that when it is pressed against the drain of the plumbing fixture, a fluid tight seal is obtained.

11 Claims, 5 Drawing Sheets

U.S. PATENT DOCUMENTS 4,825,900 A 5/1989 Tash
4,865,062 A 9/1989 Tash
4,895,178 A 1/1990 McHugh
4,957,123 A 9/1990 McHugh
4,986,311 A 1/1991 Mikkelson
5,085,244 A * 2/1992 Funk ..... 137/240
5,253,664 A 10/1993 Wilson
5,329,646 A 7/1994 Bevacco et al.
5,384,918 A * 1/1995 Leighton et al. ..... 4/255.05
5,524,296 A * 6/1996 Leighton ..... 4/255.05
5,727,580 A * 3/1998 Patterson ..... 134/115 R
6,163,895 A * 12/2000 Davenport ..... 4/255.06
2003/0230325 A1 * 12/2003 Barcay et al. ..... 134/146
2004/0133970 A1 * 7/2004 Gonzalez ..... 4/255.04

* cited by examiner

METHOD AND APPARATUS FOR CLEARING PLUGGED PIPES

CROSS-REFERENCE TO RELATED APPLICATIONS

This application claims the benefit under 35 U.S.C. § 119(e) of U.S. Provisional Application No. 60/483,738, filed Jun. 30, 2003, the entire content of which are hereby incorporated by reference.

BACKGROUND OF THE INVENTION

The invention relates in general to a device for clearing clogged pipes, and more particularly, to a portable device for clearing clogged pipes in holding tank systems as found on boats and recreational vehicles (RV's).

If a boat is on the ocean and the plumbing pipes clog, the toilet and sink cannot be used until the boat returns to land so the plumbing can be cleared. Similar difficulties exist with RV's. The prior art devices have a variety of deficiencies, including being bulky, being difficult to assemble and use, and having complex structure and expensive manufacturing costs. There is thus a need for a portable device to clear the clogged plumbing pipes in these types of holding tank systems.

BRIEF SUMMARY OF THE INVENTION

A drain clearing device for use on unvented plumbing fixtures having a drain and a holding tank is provided having a valve body. The valve body has a first end and a second end with a fluid flow channel therethrough, and a valve connected to a handle actuated to open and close to valve. A first fitting member and a second fitting member are connected to the first and second end of the valve body, respectively. Each of the first and second fitting members has a threaded portion on an interior sidewall thereof. A hose adaptor is connected to the first fitting member. A pipe has a first end and a second end. The first end of the pipe has a threaded portion engageable with the threaded portions of the first and second fitting members to vary the length of the device. The pipe extends through the valve in the retracted position. The second end of the pipe has a seal. The seal is sufficiently compressible such that when it is pressed against the drain of the plumbing fixture, a fluid tight seal is obtained. The valve may be a ball valve with a fluid channel sized to allow the pipe to fit through the flow channel. A flow channel having a diameter of about ½ to ¾ inches is believed suitable, and preferably, about ⅝ diameter. Each of the first and second fitting members includes a tubular fitting member, and one end of each tubular fitting member is inserted within the first and second ends of the valve body. The hose adapter preferably includes threads configured to engage a hose fitting, with an annular gasket being provided as desired.

A portable and retractable drain clearing device for use on unvented plumbing fixtures having a drain and a holding tank is further provided with a valve body, a hose adapter and a seal. The valve body has a first end an extendable second end with a fluid flow channel extending therethrough and a valve installed in the fluid flow channel. The extendable second end is movable between and securable at an extended position and a retracted position. In the retracted position the second end is located on one side of the valve body and in the extended position the second end is located on an opposite side of the valve body. The second end passes through the valve body in moving between the retracted and extended positions. The hose adapter is connected to the first end of the valve body. The seal is connected to the extendable second end. The seal is sufficiently compressible to provide a fluid tight seal when manually urged against the drain of the unvented plumbing fixture. The drain clearing device further has a valve handle for opening and closing the valve. The extendable second end includes a pipe telescoped with the valve body. The length of the drain clearing device is about 20 inches at the extended position and about 10–12 inches at the retracted position.

There is also advantageously provided a kit for a drain clearing device for use on unvented plumbing fixtures having a drain and a holding tank. The drain clearing kit has a valve body as described above and described further herein, with a pipe extending through the valve to form a retracted, compact configuration, and with the pipe passing through the valve and fastened to one end of the valve body or the device to form an extended configuration. The kit further includes a flexible hose having ends configured to place the valve body in fluid communication with a source of pressurized fluid.

There is also provided a method for cleaning the drain line of an unvented plumbing fixture having a drain placed in fluid communication with a macerator and holding tank by a drain line with one of the macerator and drain line being clogged is provided. In this method, a valve body having a first end and an extendable second end with a fluid flow channel therethrough is provided. The valve body has a valve controlled by a handle accessible to a user and a seal fastened to the extendable second end. The second end of the valve body is extended to a predetermined length. The handle is controlled to switch the valve to an open or closed position. The seal is pressed against the drain of the unvented plumbing fixture to obtain a substantially fluid tight seal. The first end of the valve body is connected to a pressurized water supply, the valve is opened and pressurized water applied to unclog the line. The valve is then shut off, the pressurized water supply is disconnected, and the second end is placed in a retracted position by having a portion telescope by passing through the valve to a retracted, storage position.

BRIEF DESCRIPTION OF THE DRAWINGS

These as well as other features of the present invention will become more apparent upon reference to the drawings wherein.

DETAILED DESCRIPTION

Figure 1:
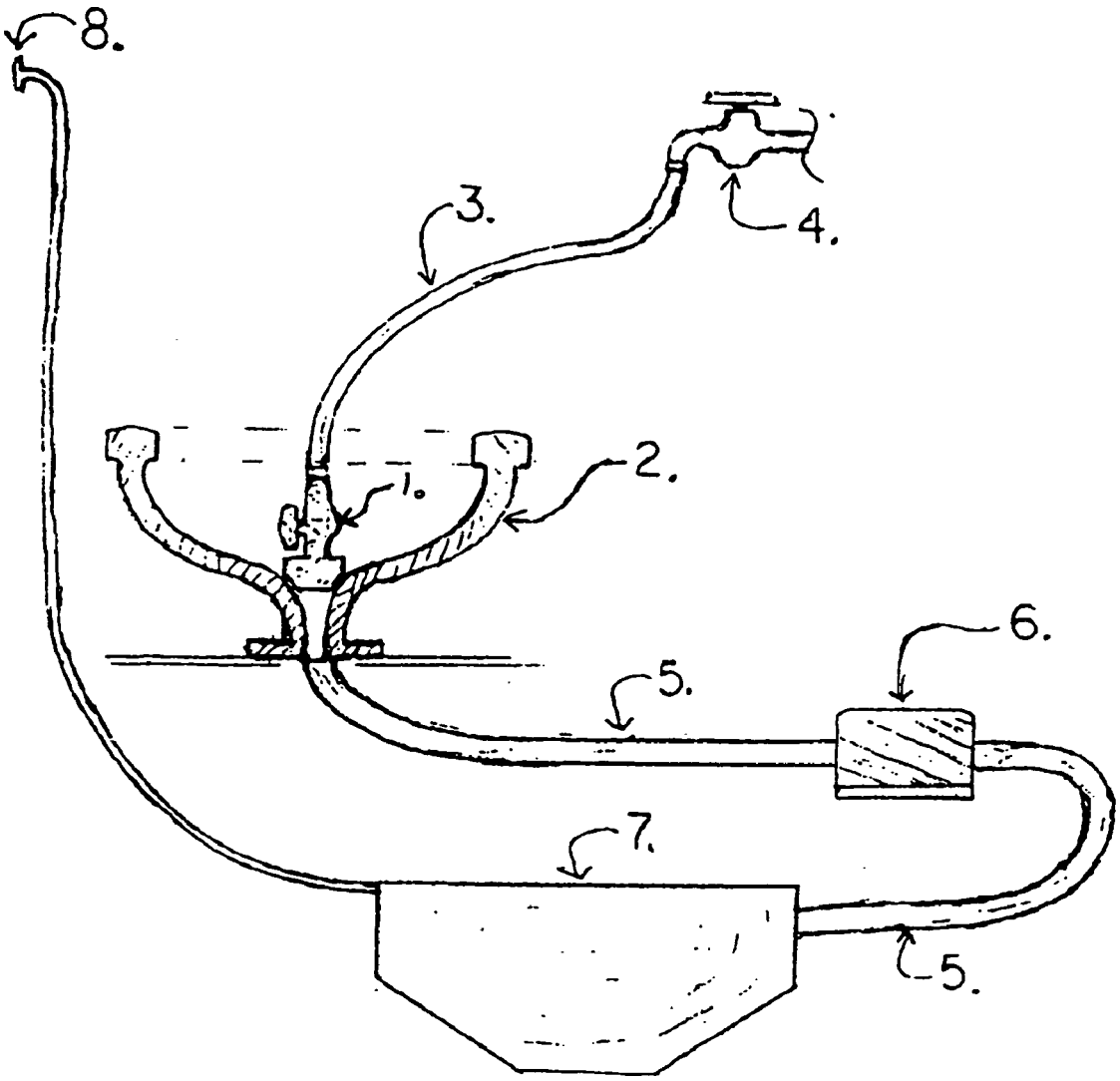
FIG. 1 is a schematic view of a retractable drain clearing device applied to a holding tank system.

Referring to FIG. 1, a drain clearing device 1 is placed in sealing relation with the drain of a plumbing fixture 2 such as a sink, toilet, shower or other plumbing fixture. If the fixture is vented, the vent is blocked. On boats and RV's, the plumbing fixtures are typically unvented so no vent need be blocked. The plumbing fixture 2 is typically connected to a macerator 6 and a septic or holding tank 7 via a drain hose 5. The hose 5 further connects the tank 7 to a vent 8. The macerator 6 uses mechanical action (e.g., interleaved plates or knives, but typically centrifugal or diaphragm pumps) to break any debris in the line 5 into smaller parts.

Figure 2:
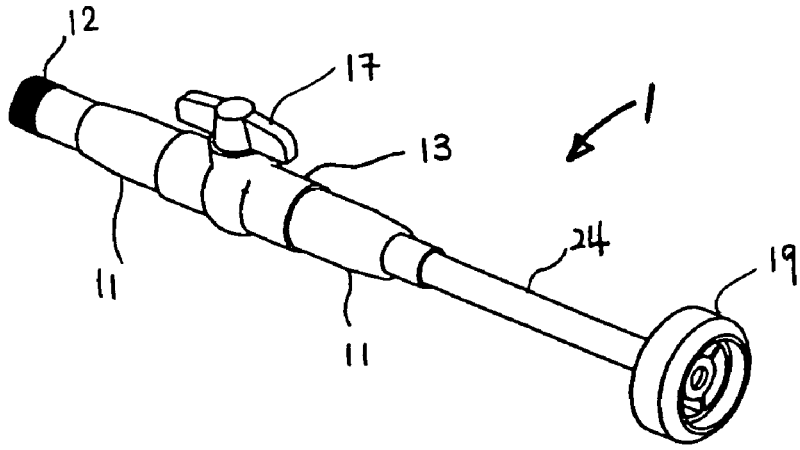
FIG. 2 is a perspective view of the drain clearing device in an extended condition.

Referring to FIGS. 1 and 2, one end of the drain clearing device 1 has a hose adaptor 12 for connecting a source of pressurized water such as a faucet 4 via a hose 3, and the other end of the drain clearing device 1 has a seal 19. The hose adaptor can take various forms, but preferably comprises a threaded connection of the type typically found on a garden hose. It can be externally threaded male threads, or internally threaded female threads. The seal 19 is sufficiently compressible that a person can press it against the drain of the plumbing fixture 2 to form a seal sufficiently tight to prevent the pressurized water from the supply 4 from squirting out past the seal.

The drain clearing device 1 further has a valve 14 (FIG. 7) located between the hose adaptor 12 and the seal 19 and an actuating valve handle 17 for controlling open/close status of the valve 14. After the faucet 4 is turned on, the valve handle 17 can be actuated to put the valve 14 in the open position, such that pressurized water supplied from the faucet 4 flows through the drain clearing device 1 and the drain hose 5 to force a blockage in the line 5 or macerator 6 blockage open, thus freeing the use of the plumbing system and the plumbing fixture 2.

The valve 14 can take various forms, and while a ball valve is shown and described this is for illustration and no by way of limitation. The drain clearing device 1 includes a valve body 13 which encloses the valve 14 therein. The valve handle 17 is connected to the valve 14, such that the user can rotate the valve handle 17 to switch the valve 14 between open and close positions. The valve body 13 has two opposing ends and a fluid flow channel extending through two opposing ends. Each of the ends is connected to a fitting member 11. Preferably but optionally, the fitting members 11 are in the form a first, distal tubular fitting member connected to the hose adapter 12 and a second, proximal tubular fitting member connected to a pipe 24 such as a PVC pipe. The distal and proximal fitting members 11 are preferably, but optionally, configured so that both fit inside the valve body 13. Preferably they take the form of a tube nesting in to a conforming recess in the body 13.

Figure 3:
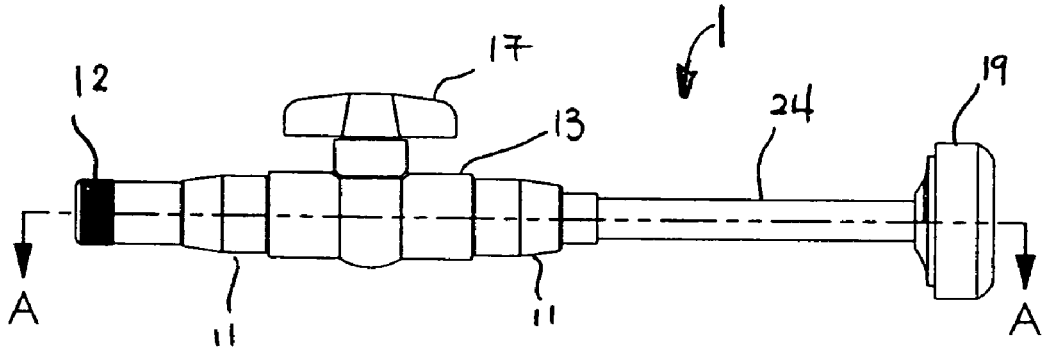
FIG. 3 is a side view of the extended drain clearing device.
Figure 4:
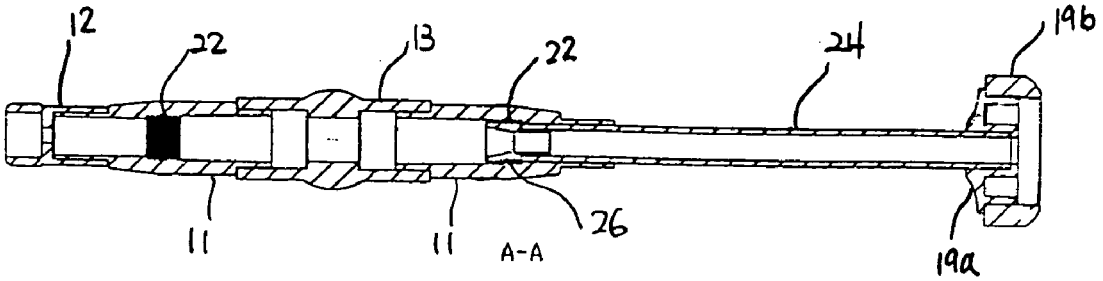
FIG. 4 is a cross-sectional view of the extended drain clearing device along line A—A.

As shown in FIG. 4, each of the distal and proximal fitting members 11 have a threaded portion 22 formed on the interior sidewall thereof. One end of the pipe 24 also includes a threaded portion 26 on the exterior sidewall thereof. The threaded portion 26 of the pipe 24 is threadingly engageable with the threaded portions 22 of both of the distal and proximal fitting members 11. When the threaded portion 26 of the pipe 24 is engaged with the threaded portion 24 of the proximal fitting valve 11, the drain clearing device 1 is in the extended condition as shown in FIGS. 2–4. The extended length provided by the pipe 24 allows the user to keep hands away from water contained in the pumping fixture 2. For example, a total length of about 20 inches is believed suitable for the extended drain clearing device 1. The threaded connection is preferably fluid-tight. An O-ring seal can be provided between the pipe 24 and portion 22 to further reduce leakage of fluids.

Figure 5:
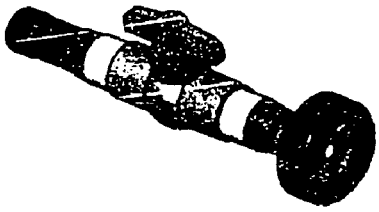
FIG. 5 is a perspective view of the clearing device in a retracted condition.
Figure 6:
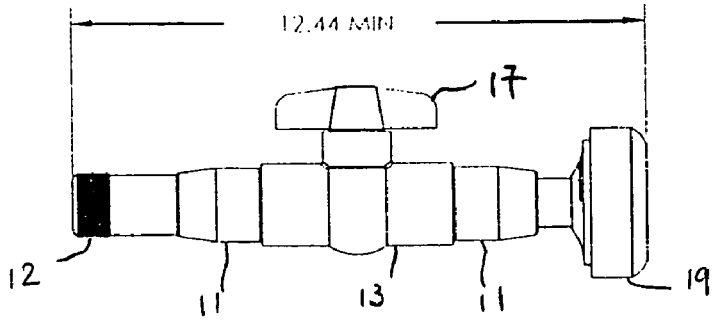
FIG. 6 is a cross sectional view of the retracted clearing device along line A–A'.

By rotating the threaded portion 26 towards the valve 14, the threaded portion 26 is disengaged from the threaded portion 22 of the proximal fitting valve 11. When the valve 14 is switched to the open position, the opening in the valve is large enough that the pipe 24 can be pushed through the valve to reach the threaded portion 22 of the distal fitting valve 11. The threaded portion 11 of the distal fitting valve 20 can then be engaged with the threaded portion 26 of the pipe 24, such that the pipe 24 is securely retracted or telescoped within the valve body 14 as shown in FIGS. 5 and 6. Preferably but optionally, the drain clearing device 1 in the retracted condition is about half the length of the extended position or slightly longer. Therefore, when the drain clearing device 1 is not in use, it is easily stored in a space about half the length. The threaded engagement prevents the pipe from accidentally extending.

Figure 7:
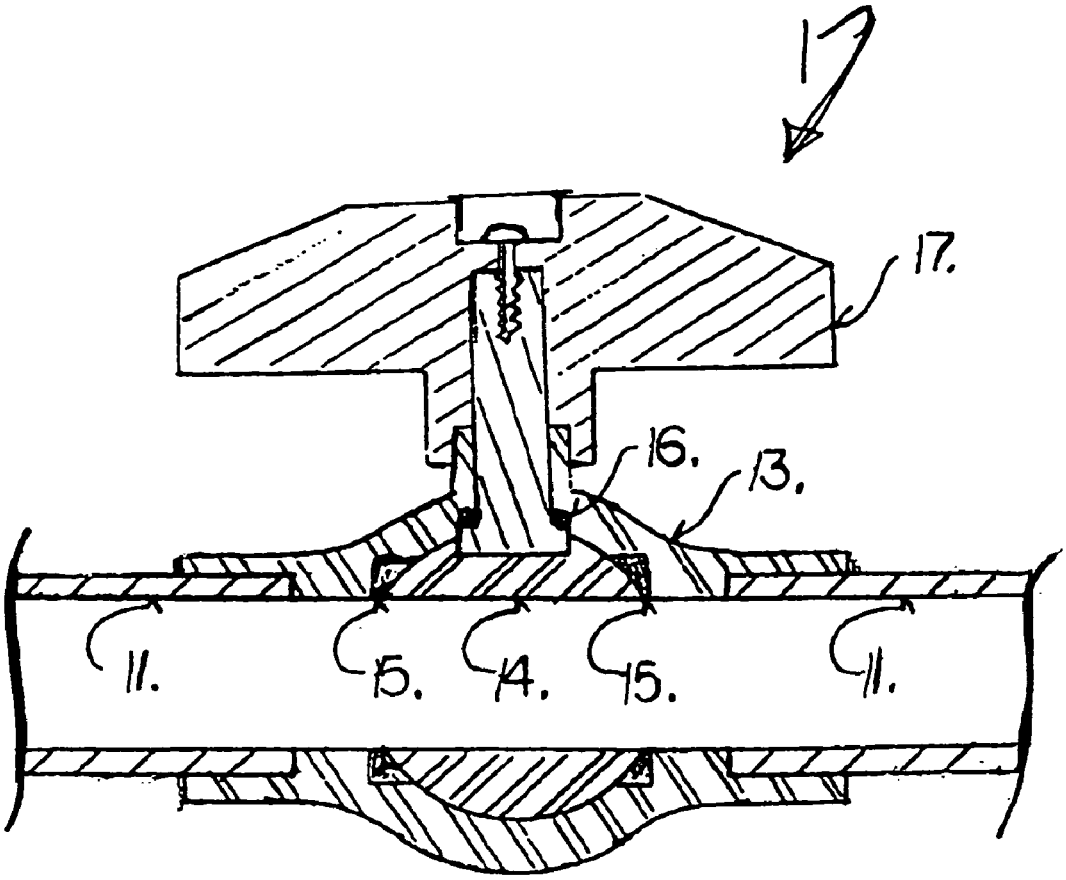
FIG. 7 is a cross sectional view of an exemplary ball valve used in the drain clearing device in the open position.

The valve 14 may include a ball valve 14 as shown in FIG. 7. The ball valve 14 is preferably a plastic ball valve fastened to a stem of the valve handle 17, but it could be of metal such as brass in a metal housing. The valve handle 17 can be manually rotated to open or close the ball valve 14 to allow fluid flowing through the channel of the valve body 13. A ball valve about ½ to ¾ preferred. The size of the ball valve affects the size of the pipe 24 which extends through the passage formed in the ball valve.

As shown in FIG. 7, seals 15, 16 are located around the rotating parts such as ball valve 14 and the connection between the ball valve and the handle 17 in order to prevent leakage past the seals. Seal 16 is an O-ring seal, and seal 15 could be an O-ring seal or a seal with a triangular cross-section, or other packing material. It will be appreciated that in addition to the ball valve, other types of valves can also be used in the valve body to control the fluid flow through the channel.

Referring to FIG. 4, the hose adapter 12 has a threaded connector for coupling to the hose 3 and also has the internal threads 22 to fasten to the threads 26 on the end of pipe 24 that is internal to the device 1. A seal such as a washer can be provided at the end for connecting the hose 3 in order to help prevent leakage from the connection with the hose 3.

The opposing end of the device 1, comprising the free distal end of the pipe 24, is encircled by the seal 19. The seal 19 preferably has two parts, an annular support bracket **19*a* encircling the second end of the pipe 24, and a sealing face 19*b* abutting the support bracket 19*a* and facing the plumbing fixture to be sealed. The sealing face 19*b* preferably comprises a neoprene seal. In the illustrated embodiment, the bracket has an inner tubular wall that nests outside the distal end of pipe 24, and has a further concentric, annular flange which nests inside the neoprene seal 19*a*. The annular flange can be slotted to allow more flexibility. The annular flange provides a stiffer resilient force to resiliently urge the seal material 19*a* against the plumbing fixture while the seal 19*a* forms the fluid tight seal with the plumbing fixture. A neoprene spud seal is believed suitable to serve as the seal 19**.

Figure 8:
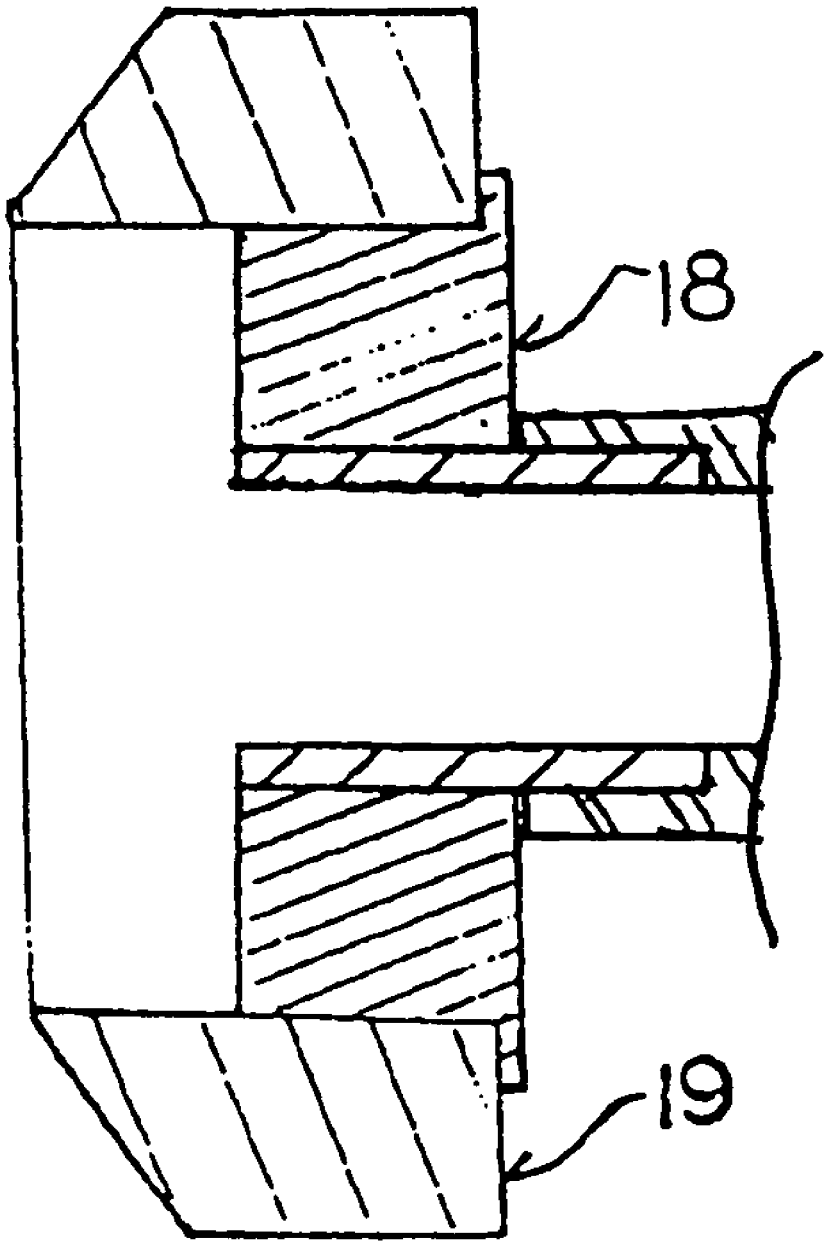
FIG. 8 is a cross sectional view of a further embodiment of a seal.

A further embodiment is shown in FIG. 8, in which an annular support or bushing 18 is fastened to the end of the pipe 25. The seal 19 is in turn fastened to and supported by the bushing 18. The bushing is preferably made of plastic and is stiffer than the compressible seal 19. The depicted seal is annular with an inclined surface sized to abut the opening of the drain and form a seal with the drain.

The seal 19 is preferably sufficiently compressible that a person can press it against the drain of the plumbing fixture 2 and form a seal sufficiently tight to prevent pressurized water from supply 4 from squirting out. A neoprene spud seal is believed suitable.

The drain clearing device 1 allows the pressurized water source 4 to be connected to the drain of the plumbing fixture 2. The handle 17 is used to close ball valve 14 to seal the fluid passageway through the drain clearing device 1. The user then forms a fluid tight seal between the seal 19 on the drain clearing device 1 and the drain of the plumbing fixture, and then opens the fluid passage using the handle 17 while ensuring the seal with the drain is maintained. The pressurized water forces the blockage into the holding tank.

In households, the drain line is vented near the plumbing fixtures so that the pressurized water from drain clearing device 1 would typically flow up the vent, but preferably not out the top of the vent. Preferably the drain clearing device 1 is made of plastic, with PVC being believed suitable.

Referring to FIG. 1, in use, the pipe 24 is unthreaded from threads 22 and extended to engage threads 26, thereby extending the length of the device 1. One end of the device 1 is placed in fluid communication with a fluid source, such as by connecting hose 3 to threaded end 12 and to a water faucet, and turning on the faucet. The valve 14 is closed so no water escapes. A person manually pushes the seal 19 against the opening to the plumbing fitting which is plugged sufficiently to form a seal. The valve 14 is then turned on and the pressurized water clears the line, at which time the valve 14 is shut off. The lever adjusts the pressure as desired to avoid leaks and to purge the line through the applied pressure. When the line is cleared, the handle 17 is shut off. The water pressure is shut off and the hose 3 disconnected. The pipe 1 is retracted into the body of the device 1 which is then stored for further use. If desired, a loop can be fastened to the device 1 to make it easier to hang it.

The extendable length of the device 1 allows a user to extend the length and make it easier to apply sufficient pressure to seal the device against the pluming fixture 2. The valve 14 provides an enlarged section which a person can grip to apply a force to better seal the seal 19 against the plumbing fixture. If desired, a handle (preferably removable) can be added to one or more sides of the device as desired to allow force to be applied. Two opposing handles fastened to the distal portion 11 are believed preferable if handles are used, and they can be threaded to the device 1 if desired. Alternatively, the threaded end 12 could be formed at right angles to the longitudinal axis of device 1 in order to provide a location on the longitudinal axis against which a person's weight could be applied to better form a seal.

The threads 22, 26 could be replaced by other other known rotational latching mechanisms, such as a bayonet lock. The device 1 is shown as being assembled from a number of separate parts, each of which can be separately formed and readily assembled. This reduces costs and provides small, compact device.

The above description is given by way of example, and not limitation. Given the above disclosure, one skilled in the art could devise variations that are within the scope and spirit of the invention. Thus, for example, there could be a female threaded portion encircling the distal end of the pipe 24 adjacent the seal 19, which could engage external male threads on the end of coupling 11 when the pipe 24 is in the storage position, in order to lock the pipe from moving. Other releasable locking mechanisms could be used to hold the pipe 24 in position relative to the valve 13, especially in the collapsed position, including hook and loop, hooks, detent fasteners, and various locks that engage and disengage with rotation. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A portable and retractable drain clearing device for use on unvented plumbing fixtures having a drain and a holding tank, the drain clearing device comprising:

a valve body, having a first end and an extendable second end with a fluid flow channel extending therethrough and a valve installed in the fluid flow channel for controlling the flow of fluid through the valve body, said valve having a valve flow channel therethrough which aligns with the valve body flow channel when the valve is in the open position, wherein the extendable second end is movable through the valve flow channel toward the first end to form a retracted position and movable out of the flow channel and away from the first end to an extended position; and a first rotational latch for removably securing the valve body in the extended position;

a hose adapter connected to the first end of the valve body; and a seal connected to the extendable second end, the seal being sufficiently compressible to provide a fluid tight seal when manually urged against the drain of the unvented plumbing fixture.

2. The drain clearing device of claim 1, further comprising a valve handle for manually opening and closing the valve.

3. The drain clearing device of claim 1, wherein the extendable second end includes a pipe telescoped with the valve body.

4. The drain clearing device of claim 1, further comprising a second rotational latch portion for releasably fastening the extendable second end in the retracted position.

5. A kit for a drain clearing device for use on unvented plumbing fixtures having a drain and a holding tank, the drain clearing device comprising:

a valve body, having a first end and an extendable second end with a fluid flow channel extending therethrough and a valve installed in the fluid flow channel for controlling the flow of fluid through the valve body, said valve having a valve flow channel therethrough which aligns with the valve body flow channel when the valve is in the open position, wherein the extendable second end is movable through the valve flow channel toward the first end to form a retracted position and movable away from the first end to an extended position; and a first rotational latch portion for removably securing the valve body in the extended position;

a hose having ends configured to place the valve body in fluid communication with a source of pressurized fluid; and a seal connected to the extendable second end, the seal being sufficiently compressible to provide a fluid tight seal when manually urged against the drain of the unvented plumbing fixture.

6. The drain clearing device of claim 5, further comprising a valve handle for manually opening and closing the valve.

7. The drain clearing device of claim 5, wherein the extendable second end includes a pipe telescoped within the valve body.

8. The drain clearing device of claim 5, further comprising a second rotational latch portion for releasably fastening the extendable second end in the retracted position.

9. A method for cleaning the drain line of an unvented plumbing fixture having a drain placed in fluid communication with a macerator and holding tank by a drain line with one of the macerator and drain line being clogged, comprising:

providing a valve body having a first end and an extendable second end with a fluid flow channel therethrough, the valve body having a valve controlled by a handle said valve having a valve flow channel in fluid communication with the valve body flow channel, and a seal fastened to the extendable second end;

extending the extendable second end through the valve flow channel toward the first end to form a retracted position and movable away from the first end to an extended position controlling the handle to switch the valve to a predetermined no-flow position;

connecting the first end of the valve body to a pressurized water supply manually compressing the seal against the drain line of the unvented plumbing fixture to obtain a substantially fluid tight seal; and moving the handle to switch the valve to a flow-position for a time sufficient to remove the blockage; and moving the handle to switch the valve to a no-flow position.

10. The method of claim 9, further comprising unfastening the second end from the extended position and moving the second end through the valve flow channel to a retracted position having a length shorter than the extended position.

11. The method of claim 10, further comprising releasably fastening the second end to the valve body in the retracted position.

* * * * *